US005673728A

United States Patent [19]

Grifoni et al.

[11] Patent Number: 5,673,728

[45] Date of Patent: Oct. 7, 1997

[54] SLIDING NUT FOR A DOBBY LEVER

[75] Inventors: Francesco Grifoni, Vicchio; Massimo Altamore, Florence, both of Italy

[73] Assignee: Nuovo Pignone S.p.A, Florence, Italy

[21] Appl. No.: 569,364

[22] Filed: Dec. 8, 1995

[30] Foreign Application Priority Data

Jan. 10, 1995 [IT] Italy ..... MI95A0027

[51] Int. Cl.[6] ..... D03C 1/14

[52] U.S. Cl. ..... 139/66 A; 403/409.1; 403/374

[58] Field of Search ..... 403/374, 362, 403/314, 304, 409.1, 400; 74/42, 519; 139/66 A, 66 R, 79

[56] References Cited

U.S. PATENT DOCUMENTS

| | | | |
|---|---|---|---|
| H906 | 4/1991 | Bagget et al. | 403/409.1 |
| 3,186,440 | 6/1965 | League . | |
| 3,696,842 | 10/1972 | Pfarrwaller . | |
| 4,027,939 | 6/1977 | White | 403/374 |
| 4,528,768 | 7/1985 | Anderson | 403/374 |
| 5,001,831 | 3/1991 | Vinciguerra et al. . | |
| 5,044,407 | 9/1991 | Vinciguerra . | |
| 5,050,644 | 9/1991 | Peter . | |
| 5,259,419 | 11/1993 | Vinciguerra et al. . | |

FOREIGN PATENT DOCUMENTS

| | | |
|---|---|---|
| 252177 | 1/1988 | European Pat. Off. . |
| 0393750 | 10/1990 | European Pat. Off. . |
| 1 152 669 | 8/1963 | Germany . |
| 0 598 161 A1 | 4/1994 | Germany . |

*Primary Examiner*—Andy Falik

*Attorney, Agent, or Firm*—George P. Hoare, Jr.; Rogers & Wells

[57] ABSTRACT

A dobby lever which is insertable into a main lever of a textile loom includes a sliding nut to set and adjust its position along the main lever. The dobby lever has a pair of parallel flat sides, separate but fixed to each other. The sliding nut has a body which can be inserted between the sides of the main lever. The body of the sliding nut has a hole at one end for receiving a joint which can be connected to a driving bar and a blocking device at its other end for the sides of the main lever. The body at the other end has sloping surfaces, and wedge-shaped elements are provided having complimentary slanting surfaces which are insertable into a box-shaped container and act upon the sides of the main lever. A screw element is insertable into the box as a blocking device to adjust the position of the wedge-shaped elements with respect to the sloping surfaces of the body and the sides of the main lever, and a connecting element freely joins and holds the wedge-shaped elements together relative to the sloping surfaces of the body of the sliding nut.

9 Claims, 3 Drawing Sheets

SLIDING NUT FOR A DOBBY LEVER

1. Field of the Invention

The present invention relates to a sliding nut for a dobby lever.

2. Background of the Invention

In presently known fast textile looms, rotating dobbies are used in which a driving rod corresponds to each frame, activated by a rotating cam. The driving rod, in turn, controls a regulating lever for transmitting movement to the lifting equipment of the frames of the loom. The stroke is regulated according to the position of the frame with respect to the formation point of the fabric and this stroke variation can be obtained by moving the sliding nuts situated on the suitably shaped body of the lever and equipped with devices for blocking the position with respect to the lever.

In looms which use bulky levers in a single piece, the sliding nut has a cavity which is connected to and runs on the lever. This cavity should have a matching clamping screw, acting as a blocking device, which enables the steady positioning of the sliding nut on the lever. This screw is not very accessible to the operator when it is being used to block the sliding nut.

In addition the sliding nut must be inserted on the lever, at a free end of the same, and there must be a certain free space in the dobby for both the assembly and disassembly operation, which causes greater encumbrance.

A proposal has also been made for improving the structure of a dobby lever and relative sliding nut and this solution is claimed in Italian patent 1.229.284 filed by the same applicant.

In this patent a particular composite lever is described, with two parallel sheared plate sides, joined by a ring-shaped hub which acts as a fulcrum for the lever, and a damping spacer unit which is bolted in correspondence with a free end of the sides. In this way a hollow part is formed between the two sides in which a sliding nut is inserted which, by regulating its position inside the lever, allows the variation of the lifting of the frames.

However, even for removing the sliding nut such as the one described, illustrated and claimed in the above Italian patent, for example in a maintenance phase of the machine, the damping spacer block must also be removed. This entails removing the bolts situated at the free end of the sides. This operation, apart from requiring a certain amount of time, may cause an alteration in the planarity between the two sheared plates of the sides, with subsequent difficulty in the reassembly phase in re-establishing the exact position.

It is also evident that to pull out the sliding nut from the upper part of the sides of the lever, freed from the damping spacer block, it is also necessary to have a certain amount of additional space in an area immediately above the lever to be able to carry out the operation.

SUMMARY OF THE INVENTION

The object of the present invention is to provide a sliding nut which overcomes these problems and which can be particularly used in a control lever of the two-sided type.

A further object is to provide a sliding nut which does not require the disassembly of the lever parts, with a consequently more limited encumbrance in the entire dobby with respect to the present.

These objectives according to the present invention are reached by producing a sliding nut for the dobby lever of a textile loom, which can be inserted into a main lever and which consists of a pair of flat parallel sides, separate and fixed to each other, wherein said sliding nut comprises a body which can be inserted between these sides, with a hole at one end which can receive a joint which is connected to a driving rod and with a relative blocking device for these sides at the other end, characterized in that said body is so shaped at the second end as to have sloping surfaces on which wedge-shaped elements are arranged, in a complementary slanting position, which can be inserted into a box-shaped container and acting on the sides, a screw device being connected to the box-shaped element as a blocking device to determine the performance of these wedge-shaped elements with respect to the sloping surfaces and sides of the main lever.

With this kind of sliding nut there is therefore the possibility of an extremely easy and convenient assembly with respect to the main two-sided lever.

In addition, the particular structure of the sliding nut according to the invention allows a more compact sizing and limited encumbrance of the entire dobby. The particular form of the blocking devices of the sliding nut avoids the disassembly of the main lever or part of it for the assembly and/or removal of the sliding nut.

DESCRIPTION OF THE DRAWINGS

The characteristics and advantages of a sliding nut for a dobby lever according to the present invention are more clearly explained in the following description, which is illustrative and not restricting, the accompanying schematic drawings wherein.

DESCRIPTION OF THE PREFERRED EMBODIMENTS

Figure 1:
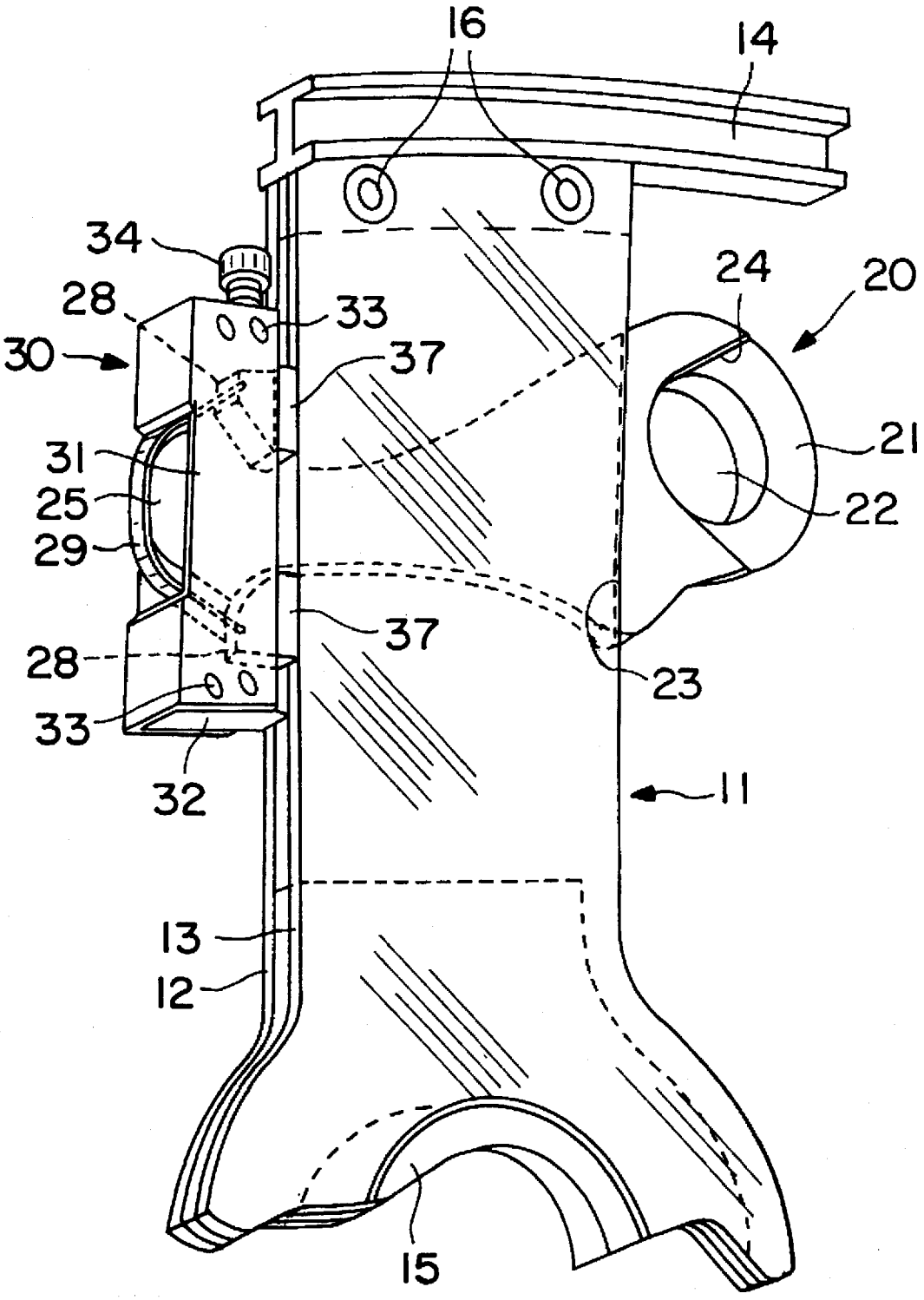
FIG. 1 is a partial perspective view of a main lever for a dobby on which a sliding nut according to the present invention is assembled, wherein the sliding nut is shown in a first assembly position.

With reference to the figures, a general illustration is given of a main lever 11, or part thereof, of a rotating dobby, which as is known can have its fulcrum on the shaft supported by a fixed part and which is driven by a relative rod, not shown herein.

The main lever 11 consists of a pair of flat parallel sides 12 and 13, made for example of calibrated plate, obtained by shearing. The two flat sides 12 and 13 are firmly held on to each other by a ring-shaped spacer hub inserted between them and blocked by tightening in the press, in which the shaft supported by the fixed part is positioned. A vibration-damping-spacer unit 14, for example fixed by rivets or bolts 16 at the sides 12 and 13 of the lever, is then inserted between the sides 12 and 13 of the lever in an upper part of the end of the main lever 11.

A sliding nut according to the present invention, entirely illustrated with 20, is assembled on the main lever 11.

The sliding nut 20 comprises a shaped body having an enlarged end 21 with a hole 22 suitable for receiving a joint not shown and for example consisting of a bearing and relative pin with which it is hinged and connected to a driving rod, which activates by levers or equivalent devices, the frames of the textile loom, not shown in the figures, for example similar to those partially illustrated in the Italian patent 1.229.284 mentioned above.

The enlarged end 21 has two shaped legdes 23 adaptable to the curved profile of the main lever formed by the two sides 12 and 13, whereas it also has possible shaped seats 24 for receiving the end of the above mentioned driving rod.

Figure 3:
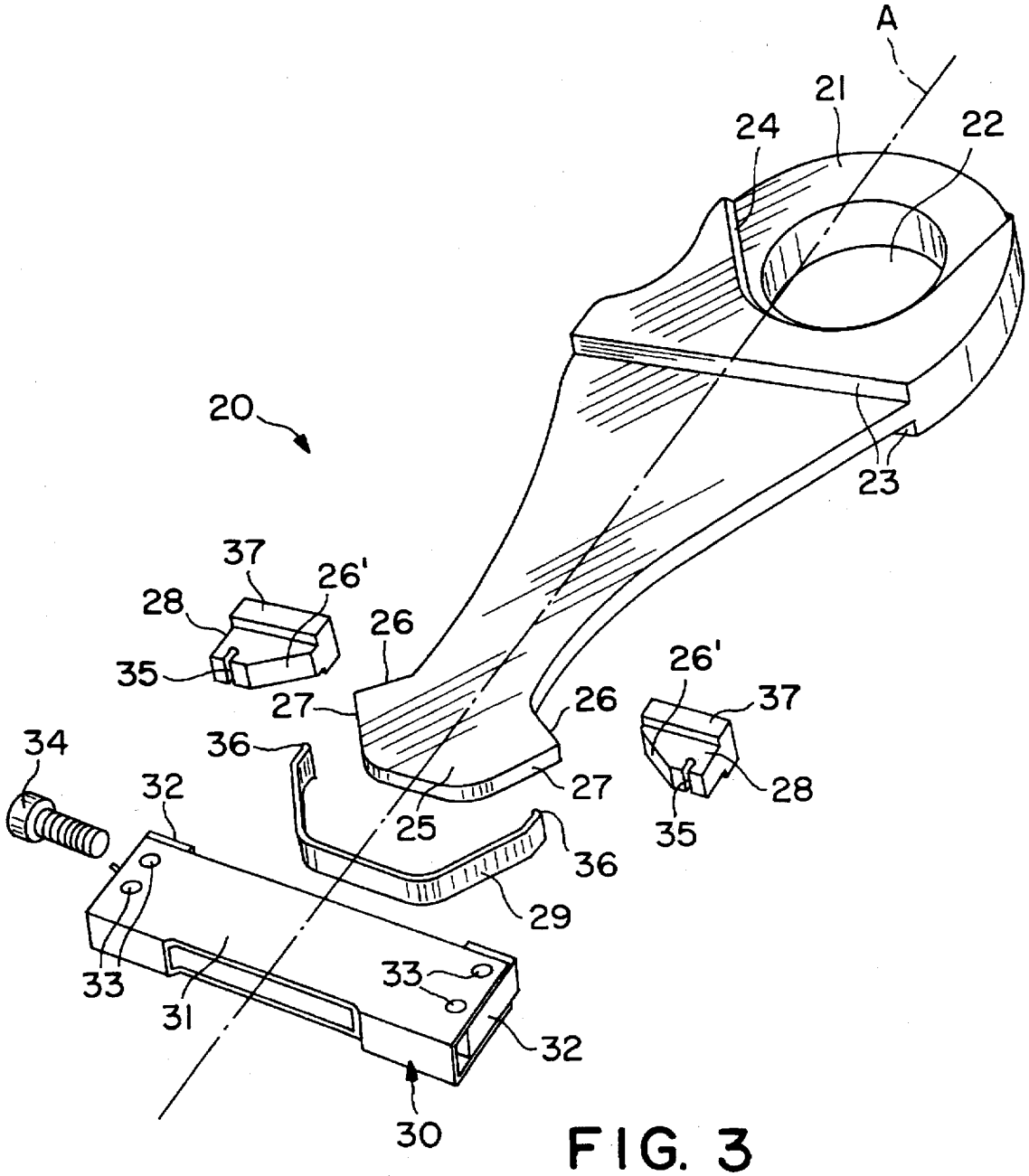
FIG. 3 is a blown up perspective view of the sliding nut alone according to the present invention.

The central portion of the body of the sliding nut 20 has a thinned portion which is linked to a second end 25 which generally is T-shaped as illustrated on FIG. 3. This second T-shaped end 25, in the part facing the central portion of the sliding nut, has two slanting layers or parts joining it. In the upper portion there is a rounded surface 27 connecting the free ends of the two slanting layers 26.

The sliding nut 20 has blocking devices which comprise a pair of wedged-shaped elements 28, having a complementary shape and slant with respect to the slanting layers 26. This pair of wedge-shaped elements 28 is kept together by means of an elastic connecting element 29, which prevents the accidental separation of the parts. In this way, both the slanting layers 26 and connecting element 29 form a group which can be positioned on the second T-shaped end 25.

A box-shaped element 30 can be inserted on the second end 25 of the body of the sliding nut 20 once the two wedge-shaped elements 28 have been positioned on the slanting layers 26 and held by the connecting element 29, so as to complete the blocking device of the sliding nut.

The box-shaped element 30 comprises for example a sheet 31, U-folded to form the two sides or lateral walls thereof. These sides are fixed to each other by end-blocks 32 inserted between them and fixed by rivets 33 or similar blocks. In one of these end-blocks 32 there is a thread-ring, not shown, in which a blocking screw 34 of the sliding nut with respect to the main lever on its lateral configuration, can be inserted and positioned. This screw acts between the box-shaped element 30 and the relative block 32 and determines the movement, or wedging with respect to the sloping surfaces of the second end 25 of the body of the sliding nut.

Figure 2:
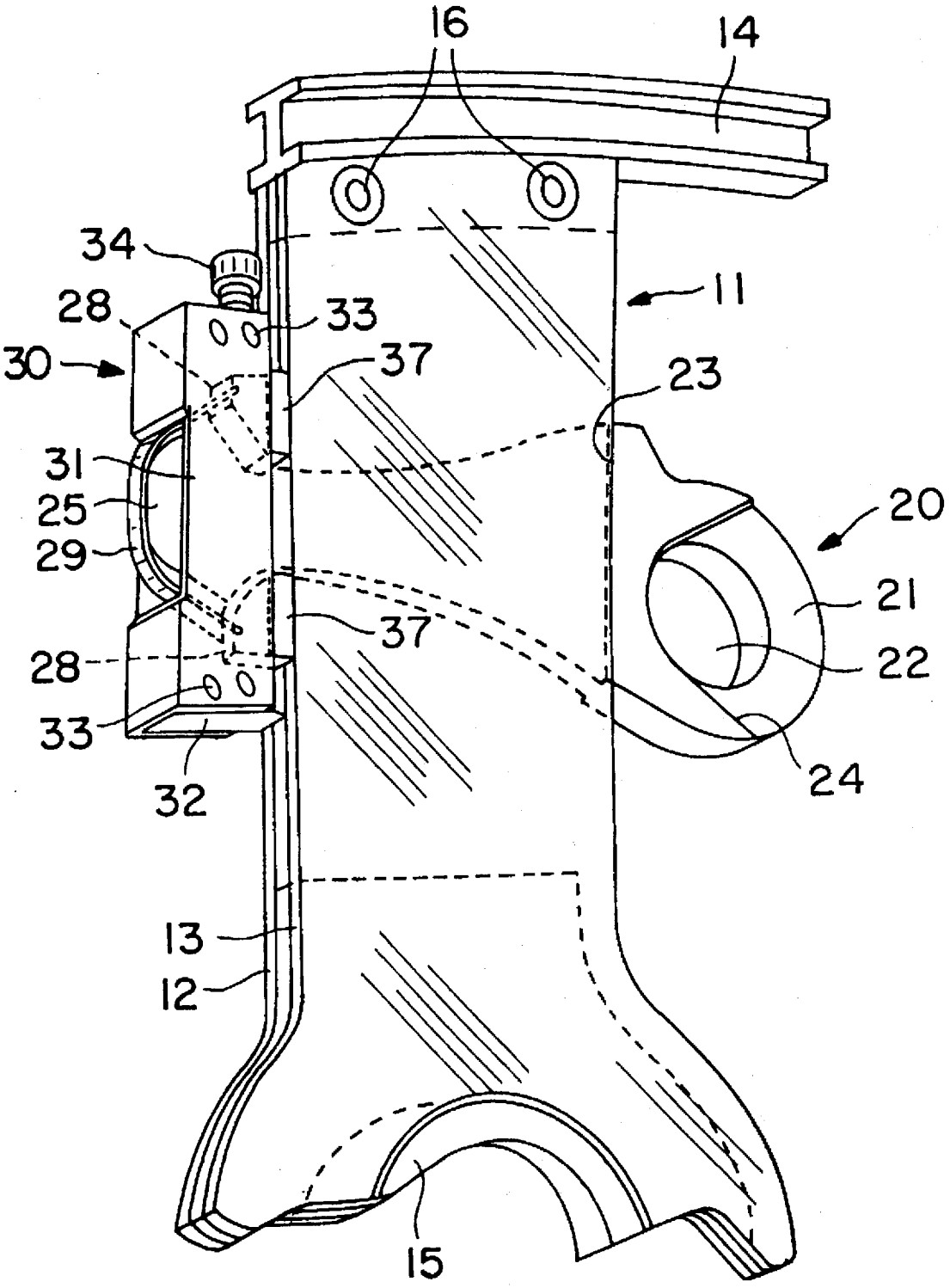
FIG. 2 is a partial perspective view completely similar to FIG. 1 with the sliding nut illustrated in a second assembly position.

Although it is possible to obtain the body of the sliding nut with the opening 22 in line with the longitudinal axis A, in the embodiment illustrated the body of the sliding nut has the first enlarged end 21 in an eccentric position with respect to the axis A. It is possible, also with this eccentric conformation, with a sliding nut according to the present invention, to have a reverse/upside-down assembly. This possibility of a different assembly is clearly shown in FIGS. 1 and 2. This possibility allows, with the same range of the sliding nut 21 on the lever 11, a greater variation in the span of the frame. As a result, there is a reduced encumbrance of both the lever and the sliding nut.

This is also possible as the second T-shaped end 25 of the body of the sliding nut can be placed in the box-shaped element in several positions so that the regulating screw always acts correctly in an upward position. In this way the operator can block the sliding nut on the main lever in the position which is necessary for obtaining the desired span of the frame.

The blocking of the wedge-shaped elements can also be carried out in both of the positions of the second end 25 of the wedge body because the blocking action takes place indifferently on one wedge or another, as these are inserted in the box-shaped element which keeps them in the correct position with respect to the second T-shaped end of the body of the sliding nut.

The particular inclination of the slanting layers 26 and facing surfaces 26' of the wedge-shaped elements 28, for example of between 20° and 45°, permits the development of blocking forces between the sliding nut and main lever which are actually double with respect to the known art without slanting layers. In addition, this inclination also favors the release of the strain of the parts, and it automatically causes the reopening of the wedge-shaped elements.

For this purpose, as is clearly shown in FIG. 3, it can be seen that each of the wedge-shaped elements 28 has a seat 35, which widens towards the inside, and which is suitable for receiving the enlarged ends 36 of the connecting element 29. From the opposite part of these wedge-shaped elements 28 facing the sides 12 and 13 and at the open part of the sheet 31 the wedge-shaped elements have enlargements 37 which provide ledges for these. In addition, as illustrated for example in the same figure, it can be seen how the connecting element 29, in one form of embodiment which is not limiting, can consist of an elastic plate.

It is easy to understand that the sliding nut of the present invention can be assembled without removing the vibration-damping spacer unit situated at the end of the main lever.

In fact, by removing the blocking screw from its clamping position on the side of the configuration of the main lever, the box-shaped element can be removed from above the wedges placed in their operating position. It is subsequently possible to remove the wedges themselves, by extending the connecting element between them. Finally, the body of the sliding nut can be pulled out from the cavity situated between the two sides of the main lever.

It is therefore not necessary for the main lever to be involved at all in the disassembly and in this way it does not lose its correct conformation, obtained for example by leveling, after the assembly operation, the two sides by means of the ring-shaped spacer hub and the vibration-damping spacer unit.

Any possible reconstruction of the planarity of the main lever is therefore eliminated and this also acquires greater stability. The controls are consequently reduced to a single control in the first assembly phase of the main lever.

The elimination of the necessity existing in all the control levers of the previous art of having to pull the sliding nut out of the end equipped with the vibration-damping spacer unit, also has other advantages.

A first advantage is being able to lower the upper limit of the machine making it more compact, which is extremely advantageous in looms or textile machines where there is an enormous quantity of mechanisms and controls.

A second advantage is being able to shorten the control lever with a further saving of space, as well as, as a consequence, of materials and operations.

We claim:

1. A sliding nut for a dobby lever of a textile loom is insertable into a main lever, said main lever having a pair of parallel flat sides separate but fixed to each other, wherein the sliding nut comprises a body which can be inserted between the sides of the main lever, and at one end of which is a hole adapted to receive a joint which can be connected to a driving bar and at the other end of which is a relative blocking device for the sides of the main lever, the body at the other end having sloping surfaces on which there are wedge shaped elements having complementary slanting surfaces, which are insertable into a box-shaped container and which are adapted to act upon the sides of the main lever, said sliding nut further comprising a screw element insertable into the box container for serving as a blocking device to adjust the position of the wedge-shaped elements with respect to the sloping surfaces of the sliding nut and said sides of the main lever, and a connecting element which is insertable into said box shaped container and which is adapted to freely join and hold the wedge edge elements together relative to the sloping surfaces of the body.

2. The sliding nut for a dobby lever according to claim 1, characterized in that said connecting element has elastic properties.

3. The sliding nut for a dobby lever according to claim 2, characterized in that said other end of the body of the sliding nut has a thin portion which is linked to the central portion, said thin portion serving as a connecting zone between the two sloping surfaces on which the connecting element is joined.

4. The sliding nut for a dobby lever according to claim 3, characterized in that said connecting zone is complementary to that of the connecting element.

5. The sliding nut for a dobby lever according to claim 2, characterized in that said wedge-shaped elements have a seat for each end of said connecting element.

6. The sliding nut for a dobby lever according to claim 1, characterized in that said other end of said body is T-shaped defining a central portion between two-ends wherein the sloping surfaces of said body are directed towards the central portion.

7. The sliding nut for a dobby lever according to claim 1, characterized in that the box-shaped container comprises a U-folded sheet having lateral parts and ends, wherein end blocks are inserted into each end of the box-shaped element and secured to said lateral parts to join said lateral parts together.

8. The sliding nut for a dobby lever according to claim 7, characterized in that said screw of the blocking device is inserted in a thread ring of one of said end blocks.

9. The sliding nut for a dobby lever according to claim 1, characterized in that said body of the sliding nut has a longitudinal axis and the hole at said one end of said body is eccentrically positioned end with respect to said longitudinal axis.

* * * * *